US012791242B2

(12) United States Patent
Rowe et al.

(10) Patent No.: US 12,791,242 B2
(45) **Date of Patent: *Nov. 10, 2026**

(54) COOLER WITH RETENTION STRAP

(71) Applicant: Viking Cooler Products, L.L.C., Saint Charles, MO (US)

(72) Inventors: Andrew Scott Rowe, St. Louis, MO (US); Michele L. Dando, St. Louis, MO (US)

(73) Assignee: Viking Cooler Products, L.L.C., Saint Charles, MO (US)

( * ) Notice: Subject to any disclaimer, the term of this patent is extended or adjusted under 35 U.S.C. 154(b) by 121 days.

This patent is subject to a terminal disclaimer.

(21) Appl. No.: 18/774,624

(22) Filed: Jul. 16, 2024

(65) Prior Publication Data

US 2024/0369281 A1 Nov. 7, 2024

Related U.S. Application Data

(63) Continuation of application No. 17/227,880, filed on Apr. 12, 2021, now Pat. No. 12,050,051.

(51) Int. Cl.
*F25D 3/08* (2006.01)
*A63B 55/60* (2015.01)

(52) U.S. Cl.
CPC ..... *F25D 3/08* (2013.01); *A63B 55/61* (2015.10)

(58) Field of Classification Search
CPC . F25D 3/08; A63B 55/61; A45C 11/20; A45F 3/00
See application file for complete search history.

(56) References Cited

U.S. PATENT DOCUMENTS

| | | | | |
|---|---|---|---|---|
| 5,288,001 | A * | 2/1994 | Locarno | A61G 5/1054 224/567 |
| 5,403,095 | A * | 4/1995 | Melk | A45C 11/20 383/110 |
| 5,407,111 | A * | 4/1995 | Lanouette | A45F 3/00 383/33 |
| 6,601,745 | B2 * | 8/2003 | Tyrer | B60N 2/24 383/110 |
| 10,799,002 | B2 * | 10/2020 | Bradley | A45C 7/0081 |
| 11,117,732 | B2 * | 9/2021 | Seiders | A45C 13/30 |
| 2022/0097915 | A1 * | 3/2022 | Geier | B65D 25/2817 |

* cited by examiner

*Primary Examiner* — Corey N Skurdal
(74) *Attorney, Agent, or Firm* — Erise IP, P.A.

(57) ABSTRACT

A system and device for a removably attachable golf cart cooler. Embodiments of the golf cart cooler provide for a soft-shell cooler that is removably attachable to the front of a motorized golf cart, the cooler comprising a continuous retention strap positioned across the exterior of the cooler. The continuous retention strap may comprise fasteners for attaching the golf cart cooler to a golf cart. While attached, the continuous strap can help to distribute weight across the entire length of the continuous strap, alleviating tension on the fasteners. Additionally, the continuous strap can act as a retention member, aiding in maintaining the shape and rigidity of the cooler and preventing contents from falling out.

20 Claims, 5 Drawing Sheets

COOLER WITH RETENTION STRAP

RELATED APPLICATIONS

This patent application is a continuation application claiming priority benefit, with regard to all common subject matter, of U.S. patent application Ser. No. 17/227,880, filed Apr. 12, 2021, and entitled "COOLER WITH RETENTION STRAP." The above referenced patent application is hereby incorporated by reference in its entirety into the present application.

BACKGROUND

1. Field

Embodiments of the invention relate to a soft-shell cooler. More specifically, embodiments of the invention relate to a cooler that may be attached to a golf cart, including a front of the golf cart.

2. Related Art

Motorized golf carts are a popular accessory used by golfers of all ages to traverse the golf course. It is common for golfers to bring their own coolers filled with drinks, snacks, ice, and ice packs, particularly during the summer months. Many commercial golf cart coolers are designed to fit in a storage space located behind the seats in a golf cart. However, most of these storage spaces are limited in size and are designed primarily for jackets and other smaller items, making it difficult for large-sized coolers to fit in the storage space. Small-sized coolers that are able to fit in the storage space have limited storage capabilities, creating issues for large groups of golfers and even solo golfers in the summer months. In addition to the limitation in size, placing a cooler in the storage space occupies the space intended for storing other items, such as jackets or golfing accessories. In an attempt to solve this problem, some golf cart coolers have been designed to be placed on the exterior of the golf cart.

An example of one such a large-sized cooler is U.S. Pat. No. 6,601,745 to Stephen Edward Tyler and sold commercially by CLUB PRO™. This patent describes a cooler designed to be positioned on the front of a golf cart and comprises a soft-shell, collapsible body. This cooler can be attached to the front of a golf cart. The cooler is not limited in size by the golf cart storage space, and instead, can be as wide and tall as the front face of the golf cart. However, such a design includes several disadvantages. The cooler described in the '745 patent comprises a four-strap mounting system. The '745 patent describes utilizing two straps (one with a male buckle and one with a female buckle) corresponding to a right corner of the cooler, and two straps (one with a male buckle and one with a female buckle) corresponding to a left corner of the cooler. The straps of each corner are then buckled together around the corresponding frame members, or A-pillars, of the golf cart. In the '745 patent's design, there are four points of contact with weight and force focused on each point, thereby creating four potential points of failure. Therefore, if one strap breaks or fails, the cooler will become unattached.

Additionally, the cooler described in the '745 patent is constructed from a flexible material and comprises no support structures to keep the cooler rigid, preventing contents from spilling out. Oftentimes, when the cooler is full and attached to a golf cart, there is a tendency for the items to congregate at one point, causing the sidewall to lose rigidity and flex outward and allowing the contents to spill out from the cooler.

Accordingly, what is needed is a large-sized golf cart cooler that is both portable and flexible, but which is also able to retain its shape and rigidity. A need also exists for a cooler that can disperse the force applied to the mounting or fastening system to prevent or reduce the chance of system failure.

SUMMARY

A first embodiment of the invention is directed to a cooler that is removably attachable to the front of a motorized golf cart. The cooler comprises a main body constructed from a flexible thermally insulating material, the main body having a base and at least one sidewall. The cooler further comprises a lid constructed from a flexible thermally insulating material, the lid operatively coupled to a top portion of at least a portion of the sidewall. The main body and the lid further include a mechanism for selectively transitioning the cooler from an open position to a closed position. A continuous strap is positioned on an exterior perimeter of the sidewall, the continuous strap covering at least 50% of the exterior perimeter the sidewall. The continuous strap is secured to the sidewall at a first securement point of the sidewall and the continuous strap is further connected to the sidewall at a second securement point of the sidewall. The continuous strap aids in maintaining a rigidity of the main body. The continuous strap comprises a first portion that extends beyond the first securement point between the continuous strap and the sidewall, wherein the first portion includes a first fastening mechanism. The continuous strap further comprises a second portion that extends beyond the second securement point between the continuous strap and the sidewall, wherein the second portion includes a second fastening mechanism. The continuous strap further comprises a middle portion disposed between the first portion and the second portion, wherein the middle portion of the continuous strap is further secured to the sidewall at a plurality of positions between the first securement point and the second securement point.

A further embodiment of the invention is directed to a system for a removably attachable cooler for use with a motorized golf cart. The system comprises a cooler comprising a main body constructed from a flexible thermally insulating material, the main body having at least one sidewall and a base. The cooler further comprises a lid constructed from a flexible, thermally insulating material, the lid operatively coupled to a top portion of the main body, wherein the main body and the lid further include a mechanism for selectively transitioning the main body from an open position to a closed position. The system further comprises a fastening system comprising a continuous strap positioned on an exterior perimeter of the sidewall and the continuous strap covers at least 75% of the exterior perimeter of the sidewall. The continuous strap is connected to the sidewall at a first securement point located on the sidewall and the continuous strap is further connected to the sidewall at a second securement point located on the sidewall. The first securement point is located at a generally opposite position on the sidewall from the second securement point. The continuous strap further comprises a first portion extending beyond the first securement point between the continuous strap and the sidewall, wherein the first portion includes a first fastening mechanism. The continuous strap further comprises a second portion extending beyond the second securement point between the continuous strap and the sidewall, wherein the second portion includes a second fastening mechanism. The continuous strap further comprises a middle portion disposed between the first portion and the second portion providing a continuous connection between the first portion and the second portion. The middle portion of the continuous strap is secured to the sidewall at a plurality of positions disposed between the first portion and the second portion, wherein the continuous strap is configured to aid in maintaining a rigidity of the main body.

Another embodiment of the invention is directed to a cooler comprising a main body comprising a base and a rear sidewall, a front sidewall, a first side sidewall, and a second side sidewall, wherein the base is operatively coupled to a bottom portion of the rear sidewall, the front sidewall, the first side sidewall, and the second side sidewall. The main body is constructed from a thermally insulating material. A lid is operatively coupled to a top portion of the rear sidewall. The main body and the lid further include a mechanism for selectively transitioning the main body from an open position to a closed position via the lid. A continuous strap is positioned on an exterior portion of main body and further covering at least a portion of each of the first side sidewall, the front sidewall, and the second side sidewall. The continuous strap further includes a first portion that is free and not attached to the main body and a second portion that is free and not attached to the main body, wherein the first portion comprises a first fastener and the second portion comprises a second fastener. The continuous strap is secured to the main body at a first securement point located on the first side sidewall and the continuous strap is further secured to the main body at a second securement point located on the second side sidewall, wherein the continuous strap can be further secured to any of the first side sidewall, the front sidewall, and the second side sidewall at any position disposed between the first securement point and the second securement point.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized, and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment", "an embodiment", "embodiments", "various embodiments" "certain embodiments" "some embodiments", or "other embodiments" mean that the feature or features being referred to are included in at least one embodiment of the technology. Separate references to "one embodiment", "an embodiment" "embodiments", "various embodiments" "certain embodiments", "some embodiments", or "other embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Broadly, embodiments of the present invention are directed to a soft-shell cooler constructed from a flexible, thermally insulating material that can be removably attached to the front of a golf cart. The cooler comprises a continuous strap that extends across the sides and front of the cooler, which can be used as a mounting or fastening system and as a retention aid for maintaining the shape and rigidity of the cooler.

Figure 1:
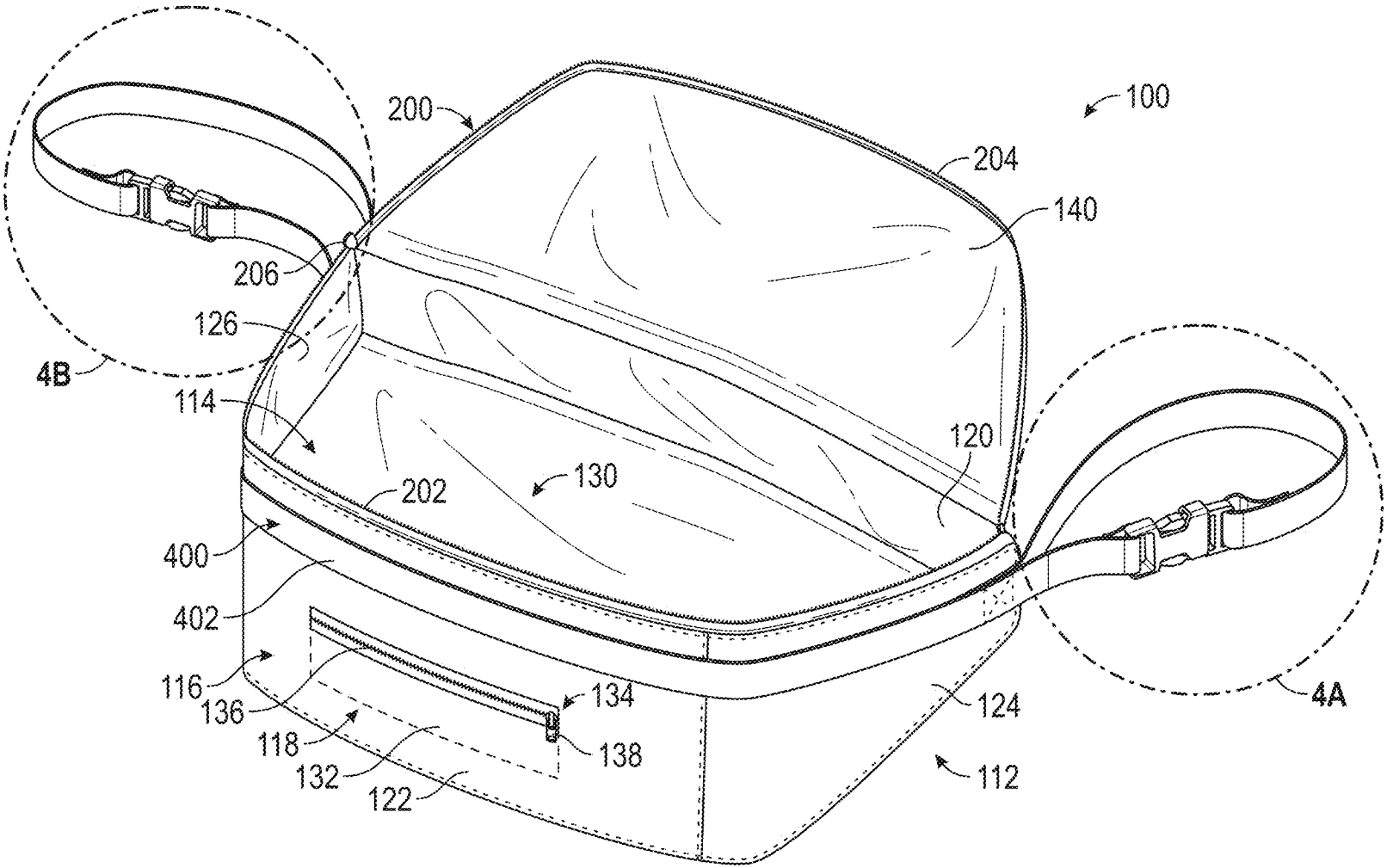
FIG. 1 is a side perspective view of a golf cart cooler in an open position in accordance with one embodiment of the present invention.
Figure 2:
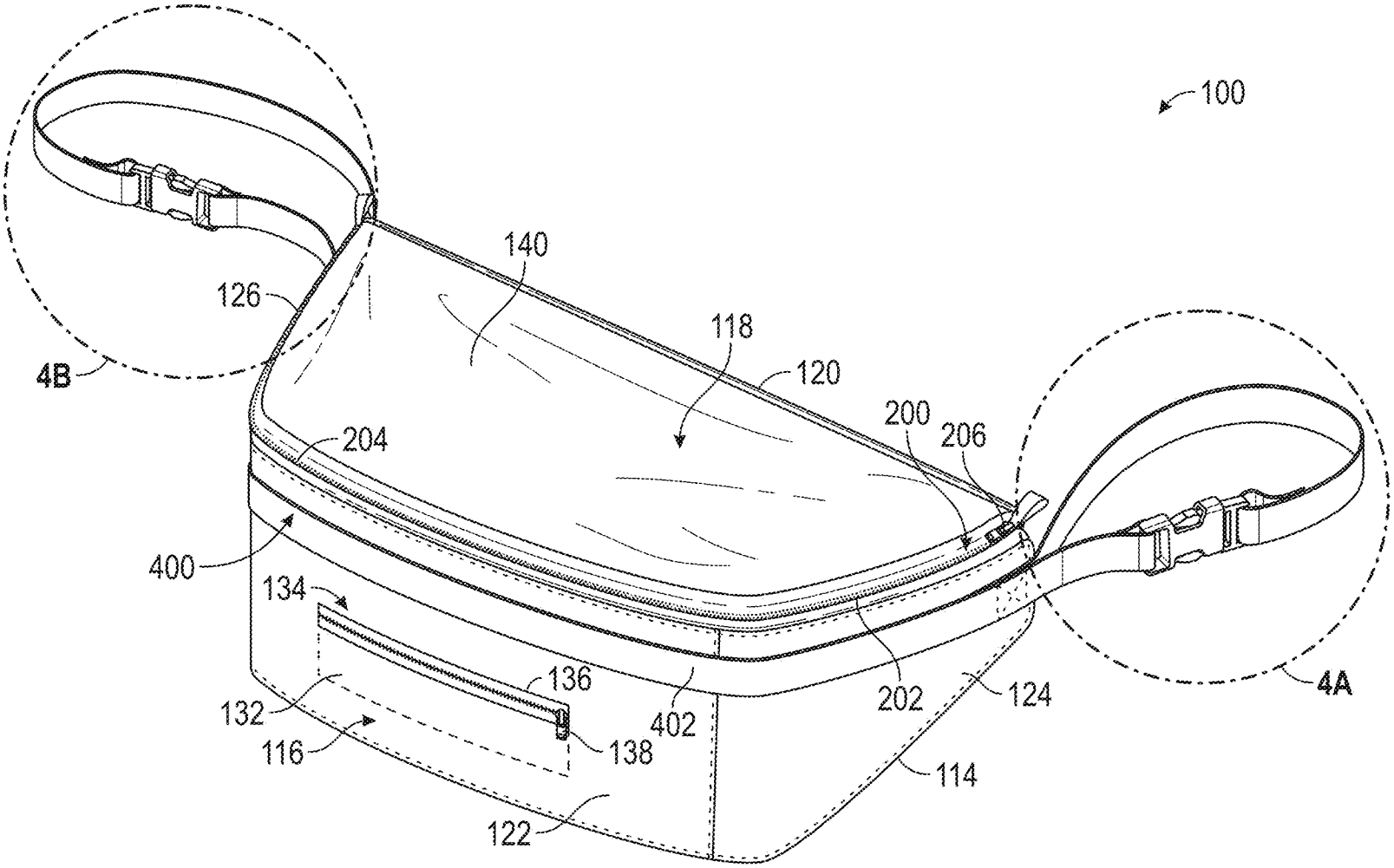
FIG. 2 is a side perspective view of a golf cart cooler in a closed position in accordance with one embodiment of the present invention.

FIG. 1 illustrates one embodiment of golf cart cooler 100 in an open configuration. FIG. 2 illustrates the embodiment of golf cart cooler 100 as illustrated in FIG. 1 in a closed configuration. Golf cart cooler 100 may comprise a main body 112 having a base 114 and at least one sidewall 116 operatively coupled to and extending upwards from base 114. Main body 112 may be constructed from any known thermally insulating material 118 including without limitation, poly (ethylene-vinyl acetate) (PEVA), nylon, polyester, foam-backed foil, cotton, neoprene, polypropylene, vinyl, or any other materials with thermally insulating materials, or any combination thereof. In some embodiments, thermally insulating material 118 can be constructed from a flexible material, having flexible or collapsible properties. The thickness of thermally insulating material 118 can vary and may comprise any desired thickness, depending on the embodiment. In some embodiments thermally insulating material 118 may be about five to thirty millimeters thick. For example, in one embodiment thermally insulating material 118 may be about fifteen millimeters thick. In some embodiments, thermally insulating material 118 may be lined with a polymer material to provide further insulation to main body 112 and, optionally or additionally, to increase resistance to wear or provide water resistance.

In some embodiments, base 114 and sidewall 116 are sewn together at corresponding edges. However, other methods of attachment may be used including adhesives, mechanical fastening methods, or any other known methods of attachment. Alternatively, thermally insulating material 118 may be a continuous layer of material comprising the entirety of base 114 and sidewall 116. The manufacturing, constructing, and assembling of soft-shell containers and coolers is well-known in the art, and main body 112 may be constructed in accordance with any known or yet to be discovered method of construction. In some embodiments, portions of main body 112 may include one or more solid components, such as for example, plastic, wood, rubber, synthetic polymer, or other material to add additional rigidity to main body 112. For example, a plastic insert (not shown) may be added to base 114, providing a solid and non-flexible property to the structure of base 114.

Main body 112 may generally be designed and manufactured in any geometric shape or design and may be, for example, cylindrical, triangular, rectangular, pentagonal, or any other polygonal geometric shape, depending on the embodiment. In some embodiments, main body 112 may comprise a plurality of sidewalls 116, or described another way, sidewall 116 may have a plurality of defined edges or sides. Alternatively, sidewall 116 may comprise a single edge or side. In some embodiments, each side or section of sidewall 116 may be equal in length and/or height. Alternatively, in some embodiments sidewall 116 may comprise sides or sections having varied or non-uniform lengths and/or heights. In some embodiments, and as illustrated in FIGS. 1-2, sidewall 116 may comprise four sides. In some embodiments, sidewall 116 may comprise a rear sidewall 120 and a front sidewall 122 connected together by a first side sidewall 124 and a second side sidewall 126. In some embodiments, rear sidewall 120 may be longer in length than front sidewall 122 and first side sidewall 124 and second side sidewall 126 may be equal in length. Accordingly, in such an embodiment main body 112 may comprise a generally trapezoidal geometric shape.

Main body 112 further comprises a storage area 130, with dimensions defined by base 114 and sidewall 116. Storage area 130 may be used for storing items such as drinks, snacks, ice, ice packs, or other desired items. In some embodiments, storage area 130 may comprise one or more retention aids (not shown) to prevent contents from moving while stored in storage area 130. For example, the retention aids may be netting, straps, or other retention aids. In some embodiments, storage area 130 may further include internal barriers (not shown) for separating or organizing items within storage area 130. For example, barriers such as netting, walls, or other dividers may be added to separate drinks from snacks.

In some embodiments, golf cart cooler 100 may further comprise at least one additional storage compartment in addition to storage area 130 for storing items such as golfing accessories that are not required to be kept cool. For example, FIGS. 1-2 illustrate one embodiment in which a secondary storage compartment 132 is located on the exterior of front sidewall 122. In some embodiments, secondary storage compartment 132 may be defined into thermally insulating material 118. Alternatively, in some embodiments secondary storage compartment 132 may be externally attached to thermally insulating material 118, and for example, could be netting or a pouch.

Secondary storage compartment 132 may be located at any position on main body 112, depending on the embodiment. Secondary storage compartment 132 may utilize a fastener 134 to selectively transition secondary storage compartment 132 from an open to a closed position. Fastener 134 may utilize any known fastening operation, mechanism, or system and may be for example a zipper, a hook and loop system, a plurality of snap fasteners, magnets, or any other known fasteners. As illustrated in FIGS. 1-2, in some embodiments fastener 134 may comprise a zipper 136 and at least one slider 138. In some embodiments, secondary storage compartment 132 may be located in the interior portion of main body 112 or otherwise within storage area 130.

As further illustrated by FIGS. 1-2, golf cart cooler 100 may comprise a lid 140, providing a top cover portion to main body 112, and which is generally configured to correspond to the geometric shape, size, and design of main body 112. Lid 140 may also be constructed from the same thermally insulating material 118 as main body 112. Alternatively, in some embodiments lid 140 can be constructed from any other material, such as plastic, rubber, foam, or other materials. In some embodiments, lid 140 may be operatively attached to a top edge of sidewall 116. In some embodiments, lid 140 may be attached to sidewall 116 along a top portion of rear sidewall 120. In some embodiments, lid 140 may be permanently attached using any known method of permanent attachment. For example, lid 140 may be molded, sewn, attached through an adhesive, or attached to main body 112 using any known method of permanent attachment. Alternatively, in some embodiments lid 140 may be removably attached to main body 112. For example, lid 140 may be attached using a releasable fastening system such as a zipper, buttons, magnets, hook and loop fasteners, or any other method of removable attachment.

In some embodiments, lid 140 may be used to selectively transition golf cart cooler 100 from an open and closed position for securely storing snacks, drinks, ice, ice packs or any other contents. When in the open position, storage area 130 can be accessible for placing, rearranging, or removing snacks, drinks, ice, ice packs, or other items. When in the closed position, storage area 130, and its contents, are covered by lid 140. In the closed position, lid 140 prevents the contents within storage area 130 from falling out. Additionally, while in the closed position, lid 140 further aids in thermally insulating the contents by acting as a barrier from warmer outside temperatures entering into storage area 130 and heating the contents. Lid 140 may further aid in preventing the cooler temperatures within storage area 130 from escaping, thereby keeping the contents cool.

Golf cart cooler 100 can utilize any known method of selectively transitioning a container, cooler, or other storage device from an open to a closed position, including but not limited to a zipper, magnets, hook and loop fasteners, buttons, or any other presently known or yet to be discovered fastening methods and systems. As illustrated in FIGS. 1-2, in some embodiments golf cart cooler 100 comprises a zipper system 200. Zipper system 200 may include a plurality of zipper teeth 202 sewn or otherwise attached to thermally insulating material 118 at the upper edge of sidewall 116. A corresponding plurality of zipper teeth 204 can likewise be sewn or otherwise attached to thermally insulating material 118 at the outer edge of lid 140. Zipper system 200 can further include at least one slider 206 for coupling and de-coupling zipper teeth 202 and zipper teeth 204 thereby selectively transitioning golf cart cooler 100 from an open to a closed position.

As further illustrated in FIGS. 1-2, in some embodiments zipper system 200 does not extend around the entire perimeter of sidewall 116 or lid 140. Instead, zipper teeth 202 is sewn to the upper edge of first side sidewall 124, front sidewall 122, and second side sidewall 126. Zipper teeth 204 is likewise sewn to the outer edge of lid 140 corresponding to the positioning of zipper teeth 202. In this embodiment, the portion of the outer edge of lid 140 corresponding to rear sidewall 120 is molded, sewn, adhered, or otherwise permanently secured to rear sidewall 120, such that lid 140 can act as a hinge. When acting in tandem with zipper system 200, golf cart cooler 100 can be selectively transitioned from an unzipped open position to a zipped closed position without completely removing lid 140. Alternatively, in some embodiments zipper system 200 can extend across the entire perimeter of sidewall 116 and lid 140. In this embodiment, when golf cart cooler 100 is transitioned from a closed position to an open position, lid 140 can be completely removed from main body 112.

Figure 3:
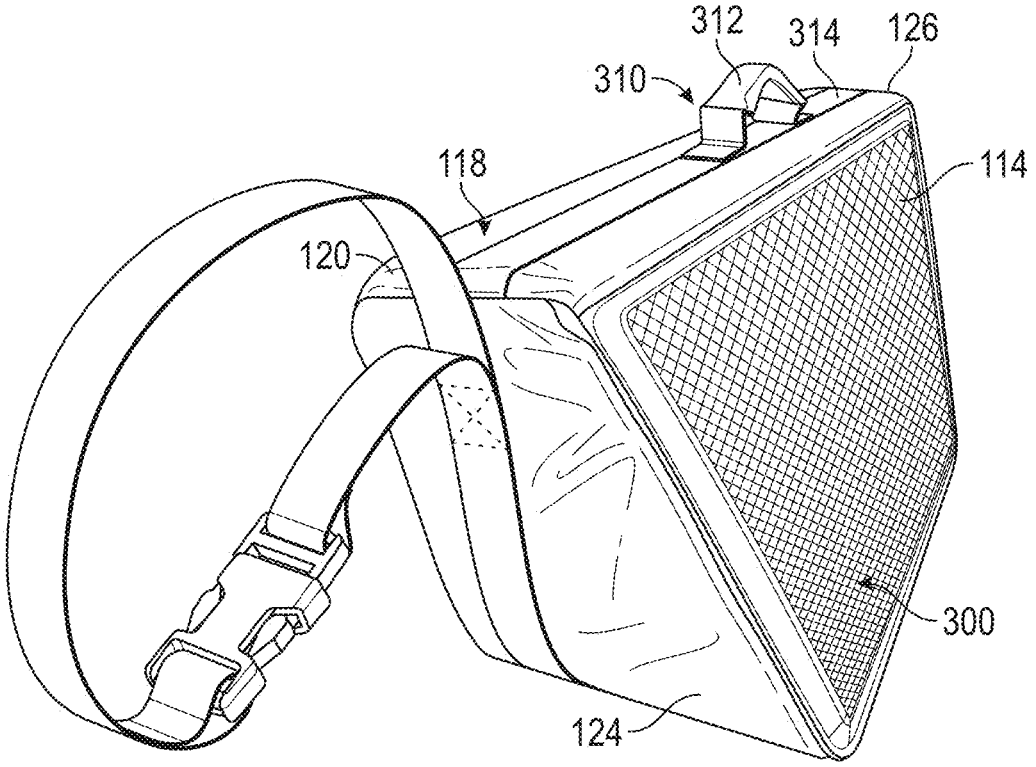
FIG. 3 is a rear perspective view of a textured bottom of a golf cart cooler in accordance with one embodiment of the present invention.

Turning to FIG. 3, golf cart cooler 100 may comprise optional or additional components or features. In some embodiments, the exterior of a bottom portion of base 114 may comprise a non-skid material 300. As illustrated in FIG. 3, in some embodiments non-skid material 300 may generally cover the entirety of the bottom portion of base 114. Alternatively, in other embodiments non-skid material 300 could be placed intermittently across the bottom portion of base 114. Non-skid material 300 may be constructed from any known non-skid material including but not limited to rubber, turf, grip tape, teak, carpet, or any other suitable non-skid or non-slip material. Non-skid material 300 may also comprise a waterproof or water-resistant property for reducing or eliminating water from entering storage area 130. The waterproof or water-resistant property may be applied to non-skid material 300 as a coating or alternatively may be manufactured into non-skid material 300. In some embodiments, non-skid material 300 could have inherent waterproof or water-resistant properties.

As further illustrated in FIG. 3, golf cart cooler 100 may additionally or optionally comprise at least one carrying handle 310. In some embodiments, carrying handle 310 may be located on the exterior of main body 112 and attached to sidewall 116. Carrying handle 310 may be constructed from polyester webbing, nylon, paracord, cotton, rubber, plastic, or other suitable material. Carrying handle 310 may further include a graspable portion 312 constructed from rubber, leather, or other tactile material to aid in gripping and holding carrying handle 310. As illustrated in FIG. 3, in some embodiments carrying handle 310 may be located roughly in the middle of rear sidewall 120, roughly equidistant from first side sidewall 124 and second side sidewall 126. However, in other embodiments the position of carrying handle 310 may vary such that it can be located at any point on main body 112 or lid 140. In some embodiments, golf cart cooler 100 may comprise a plurality of handles 310 located at multiple positions on main body 112 or lid 140.

In some embodiments, carrying handle 310 may be permanently affixed to golf cart cooler 100 and, for example, may be sewn to thermally insulating material 118. Alternatively, in some embodiments, carrying handle 310 may be permanently affixed to golf cart cooler 100 using any known methods, including without limitation, adhesives, mechanical fasteners, or any other suitable method of fastening. In some embodiments, carrying handle 310 may be removably attached to golf cart cooler 100, and may use any of the fastening methods and systems described herein for removably attaching carrying handle 310 to golf cart cooler 100. As illustrated in FIG. 3, in some embodiments main body 112 may comprise a strengthening member 314 affixed or attached to sidewall 116. Carrying handle 310 may be affixed to strengthening member 314, rather than affixed directly to thermally insulating material 118. Strengthening member 314 may be constructed from polyester webbing, nylon, paracord, cotton, or other material.

Golf cart cooler 100 may further comprise an attachment, mounting, or fastening system for attaching and securing golf cart cooler 100 to a golf cart. Turning to FIGS. 1, 2, 4A, and 4B, one embodiment of fastening system 400 is illustrated. In some embodiments, fastening system 400 may comprise one or more straps 402 positioned on the exterior surface of sidewall 116. Strap 402 may be a flexible band of polyester webbing, nylon, paracord, cotton, rubber, or other flexible material. Strap 402 may comprise a variety of dimensions, and for example may be about half an inch to about three inches in height. Alternatively, the dimensions of strap 402 may vary depending on the embodiment and can be as narrow or as wide as desired. It will be appreciated that the dimensions of strap 402 may vary and may be dependent on the height of sidewall 116. Strap 402 may be constructed as one continuous article, or alternatively, strap 402 may be constructed from a plurality of articles connected together but absent any gaps or breaks along the length of strap 402.

Strap 402 may be positioned at any vertical positioning of sidewall 116. In some embodiments, strap 402 may be positioned above a center point of sidewall 116, but below the upper edge of sidewall 116. As illustrated in FIGS. 1-2, in some embodiments strap 402 may extend across sidewall 116, and cover a portion of first side sidewall 124, front sidewall 122, and second side sidewall 126. However, in some embodiments strap 402 may cover any combination of first side sidewall 124, front sidewall 122, second side sidewall 126, and rear sidewall 120. Alternatively stated, strap 402 may cover a predetermined percentage of sidewall 116. For example, in some embodiments strap 402 may be placed and secured on sidewall 116 and cover at least 20%, at least 50%, at least 75%, at least 90%, or greater than or equal to 90% of sidewall 116. In some embodiments, strap 402 may be permanently attached to sidewall 116 through any known methods of fastening, including through the use of adhesives, mechanical fasteners, or any other known methods. For example, in some embodiments strap 402 can be sewn into thermally insulating material 118 at a plurality of positions in sidewall 116. Alternatively, in some embodiments strap 402 may be removably attached to sidewall 116. Strap 402 may be removably attached to thermally insulating material 118 using any known method of removable attachment.

As further illustrated in FIGS. 1, 2, 4A, and 4B, in some embodiments at least one portion of strap 402 may not be attached to sidewall 116, and instead, is free and extends away from main body 112. In some embodiments, a first portion 404 of strap 402 may start to extend at roughly the area where first side sidewall 124 and rear sidewall 120 connect. Alternatively, in some embodiments, first portion 404 of strap 402 may start to extend at any portion along sidewall 116. First portion 404 may comprise a first fastening mechanism 406 for securing golf cart cooler 100 to a golf cart. First fastening mechanism 406 may be any known fastening mechanism, and may be a buckle fastener, a hook, a clamp, a magnet, or any other suitable fastening apparatus, device, or mechanism. In some embodiments, the first portion 404 may be either continuous or discontinuous with the remaining portion of strap 402. That is, first portion 404 may be of the same continuous piece of material as strap portion 402, or first portion 404 may be a discontinuous and separate piece from strap portion 402.

Figure 4A:
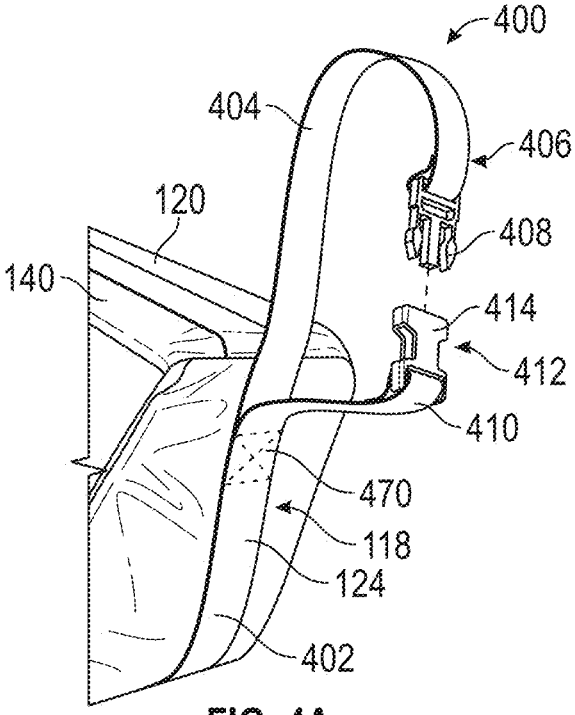
FIG. 4A is a top perspective view of a first fastening mechanism of golf cart cooler in accordance with one embodiment of the present invention.

In some embodiments, fastening system 400 may further include an additional component to cooperate with first portion 404 and first fastening mechanism 406 for securing golf cart cooler 100 to a golf cart. A first assistive portion 410 may be attached to strap 402 or sidewall 116 and comprise a first assistive fastener 412 for coupling with first fastening mechanism 406. For example, FIG. 4A illustrates one embodiment in which first fastening mechanism 406 may be a male buckle 408. First assistive portion 410 and first assistive fastener 412 may be used to couple with male buckle 408 of first fastening mechanism 406. As further illustrated in FIG. 4A, first assistive fastener 412 may be a female buckle 414. Male buckle 408 and female buckle 414 can couple together thereby forming a loop for attaching golf cart cooler 100 to a golf cart.

In some embodiments, first assistive portion 410 may be constructed of polyester webbing material, nylon, paracord, cotton, rubber, or any other suitable material, or a combination thereof. Further, it will be appreciated that in some embodiments the position of the male buckle 408 and female buckle 414 may alternate, such that first fastening mechanism 406 may comprise a female buckle and first assistive fastener 412 may comprise a male buckle. In some embodiments, first assistive portion 410 may be permanently secured to strap 402 or sidewall 116. In some embodiments, first assistive portion 410 may be permanently attached to strap 402 or sidewall 116 by any known fastening method, such as sewing for example. Alternatively, first assistive portion 410 may be removably attached to strap 402 or sidewall 116 using any known method of removable attachment.

In some embodiments, strap 402 may further comprise a second portion 450 that is not attached to sidewall 116 and instead is free and extends away from main body 112. In some embodiments, second portion 450 may start to extend at roughly the area where second side sidewall 126 and rear sidewall 120 connect. Alternatively, in some embodiments, second portion 450 of strap 402 may start to extend at any portion along sidewall 116. Second portion 450 may further comprise a second fastening mechanism 452 for securing golf cart cooler 100 to a golf cart. Second fastening mechanism 452 may be any known fastening mechanism, and may be a buckle fastener, hook, clamp, magnet, or any other suitable fastening apparatus, device, or mechanism. In some embodiments, the second portion 450 may be either continuous or discontinuous with the remaining portion of strap 402. That is, second portion 450 may be of the same continuous piece of material as strap portion 402, or second portion 450 may be a discontinuous and separate piece from strap portion 402

Figure 4B:
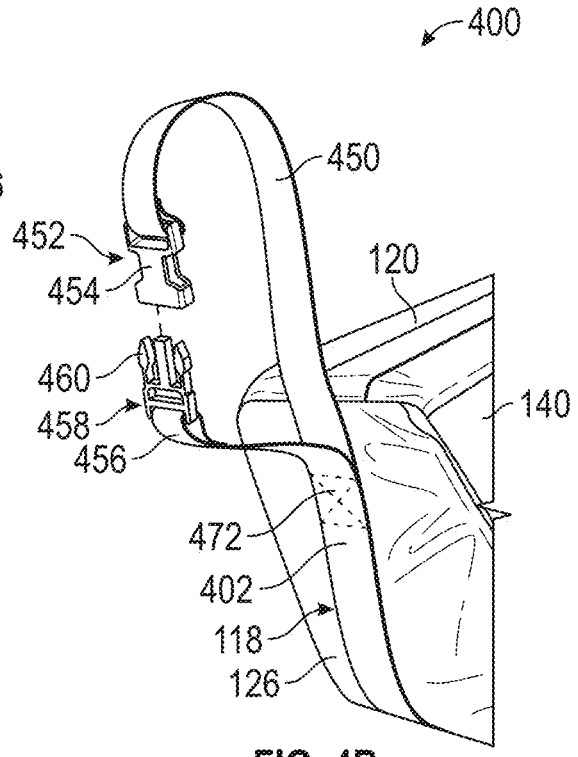
FIG. 4B is a top perspective view of a second fastening mechanism of golf cart cooler in accordance with one embodiment of the present invention.

In some embodiments, fastening system 400 may further include an additional corresponding component to cooperate with second portion 450 and second fastening mechanism 452 for securing golf cart cooler 100 to a golf cart. A second assistive portion 456 may be attached to strap 402 or sidewall 116 and comprise a second assistive fastener 458 for coupling with second fastening mechanism 452. For example, FIG. 4B illustrates one embodiment in which second fastening mechanism 452 may be a female buckle 454 and second assistive fastener 458 may be a male buckle 460. In some embodiments, second assistive fastener 458 may be used to couple with second fastening mechanism 452. For example, female buckle 454 and male buckle 460 can couple together thereby forming a loop for attaching golf cart cooler 100 to a golf cart. Second assistive portion 456 may be constructed from polyester webbing material, nylon, paracord, or any other suitable material, or a combination thereof. Further, it will be appreciated that in some embodiments the position of the male buckle 460 and female buckle 454 may alternate, such that second fastening mechanism 452 may be a male buckle and second assistive fastener 458 may comprise a female buckle.

As illustrated in FIGS. 4A and 4B and as described above, in some embodiments strap 402 may comprise two ends or portions that are not attached or connected to sidewall 116, such as first portion 404 and second portion 450, for example. In some embodiments, strap 402 is attached or secured to sidewall 116 in at least two positions, namely a first securement point 470 where first portion 404 starts to extend from sidewall 116 and a second securement point 472 where second portion 450 starts to extend from sidewall 116. In some embodiments, first securement point 470 is located on sidewall 116 at a generally opposite location to second securement point 472. Alternatively, in some embodiments first securement point 470 and second securement point 472 may be located at any position on sidewall 116. For example, in some embodiments, first securement point 470 and second securement point 472 may both be located on front sidewall 122. The remaining portion, or middle portion, of strap 402 is disposed between the first attachment position and the second attachment position. Accordingly, strap 402 may be secured or attached to sidewall 116 along any position of the middle portion of strap 402 disposed between the first attachment position and the second attachment position. In some embodiments, the middle portion of strap 402 is continuously attached to sidewall 116 across the entire length of the middle portion of strap 402. In some embodiments, the middle portion of strap 402 is selectively secured to sidewall 116, such that there can be gaps, breaks, or spots along the middle portion of strap 402 that is not secured to sidewall 116.

Figure 5:
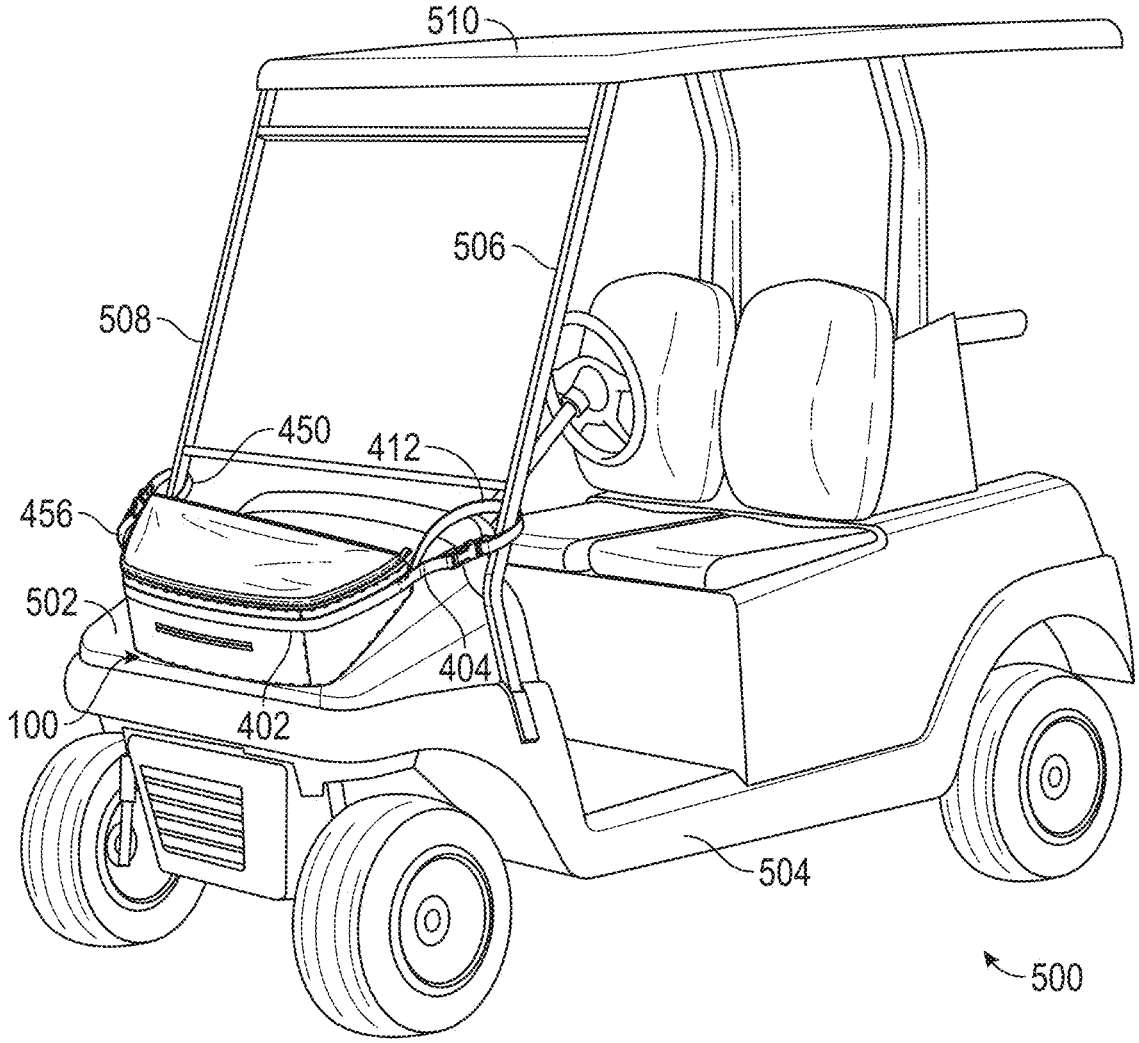
FIG. 5 is a front perspective view of a golf cart cooler secured to the front of a motorized golf cart in accordance with one embodiment of the present invention.

FIG. 5 illustrates a system comprising golf cart cooler 100 and a golf cart 500, wherein golf cart cooler 100 is attached and secured to golf cart 500 by fastening system 400. It will be appreciated that in other embodiments, golf cart cooler 100 could be attached to other motorized and non-motorized vehicles or similar apparatus including but not limited to bicycles, motorcycles, ATVs, UTVs, carts, or traditional motor vehicles comprising supports such as A-pillars, storage racks, grille guards, or other vehicle structures. Accordingly, it will be appreciated that the dimensions of golf cart cooler 100 may vary, depending on the size of golf cart 500 or similar vehicle or apparatus.

In some embodiments, golf cart 500 comprises a front face 502, a frame body 504, a first vertically extending frame member 506, a second vertically extending frame member 508, and a roof 510. As illustrated in FIG. 5, front face 502 may comprise an angled or slanted design. In some embodiments, base 114 can be designed to have a corresponding angle to approximately match the angle of front face 502. Accordingly, in some embodiments the height of sidewall 116 can likewise be designed such that when golf cart cooler 100 is placed and secured on golf cart 500, the upper edge of main body 112 is at an approximately horizontal position. For example, in some embodiments main body 112 may be designed to account for the angle or slant of front face 502 by comprising a front sidewall 122 that is taller in height than rear sidewall 120. Additionally, first side sidewall 124 and second side sidewall 126 may be designed to have a lowest positional height at the connection with rear sidewall 120 and increase in height until connecting with front sidewall 122. For example, in some embodiments front sidewall 122 may be about ten inches in height, and rear sidewall 120 may be about four inches in height. However, it will be appreciated that the heights of front sidewall 122 and rear sidewall 120 may vary depending on the embodiment.

Still referencing FIG. 5, in some embodiments golf cart cooler 100 may be placed on front face 502, with the bottom portion of base 114 in contact with front face 502. In some embodiments of golf cart cooler 100 comprising non-skid material 300, non-skid material 300 can aid in preventing slippage of golf cart cooler 100 while placed on front face 502. As further illustrated in FIG. 5, golf cart cooler 100 may be secured to golf cart 500 via fastening system 400 and positioned in a manner that creates an interior facing portion of sidewall 116 facing towards the interior of golf cart 500 and an exterior facing portion of sidewall 116 facing away from the interior of golf cart 500. In some embodiments, the interior facing portion of sidewall 116 may generally correspond with rear sidewall 120. In some embodiments, the exterior facing portion of sidewall 116 may generally correspond with front sidewall 122, first side sidewall 124, and second side sidewall 126, or any combination thereof. In some embodiments, strap 402 may be positioned and secured to at least a portion of first side sidewall 124, front sidewall 122, and second side sidewall 126, or any combination thereof, i.e., the exterior facing portion. For example, in some embodiments strap 402 may be positioned and secured to at least a portion of first side sidewall 124, front sidewall 122, and second side sidewall 126, and generally positioned such that strap 402 covers at least 20%, at least 50%, at least 75%, at least 90%, or greater than or equal to 90% of sidewall 116. In other embodiments, strap 402 may cover greater than or equal to 90% of the entire perimeter of sidewall 116. However, strap 402 may be positioned and secured against sidewall 116 such that strap 402 covers more or less of the perimeter of sidewall 116 than as previously described.

In some embodiments, first fastening mechanism 406 may be secured to first vertically extending frame member 506. For example, in some embodiments first portion 404 may surround first vertically extending frame member 506 and then couple to first assistive portion 410, thereby creating a loop around first vertically extending frame member 506 and securing golf cart cooler 100 to golf cart 500. In some embodiments, second portion 450 may surround second vertically extending frame member 508 and then couple to second assistive portion 456, thereby creating a loop around second vertically extending frame member 508 and securing golf cart cooler 100 to golf cart 500. It will be appreciated that in some embodiments fastening system 400 may further comprise adjustable fasteners for adjusting the fit of golf cart cooler 100 while attached to golf cart 500. It will be further appreciated that in some embodiments, first portion 404 could wrap around first vertically extending frame member 506, second portion 450 could wrap around second vertically extending frame member 508, and first portion 404 could couple with second portion 450 thereby attaching and securing golf cart cooler 100 to golf cart 500.

In some embodiments, fastening system 400 may use alternate fastening methods to attach golf cart cooler 100 to golf cart 500. For example, fastening system 400 could be replaced by snaps, hooks, clamps, magnets, or a magnetic strip sewn into golf cart cooler 100. In other embodiments, fastening system 400 could be used to attach golf cart cooler 100 to other locations on golf cart 500. For example, in some embodiments fastening system 400 could attach to frame body 504, roof 510, or other positions on golf cart 500.

In addition to securing golf cart cooler 100 to golf cart 500, fastening system 400 may provide additional advantages over the prior art. For example, in some embodiments strap 402 can act as a retention aid, aiding in keeping or maintaining the form, shape, and/or rigidity of golf cart cooler 100. In some embodiments, after golf cart cooler 100 is attached and secured to golf cart 500, strap 402 may act as a retention aid or otherwise provide an opposing force acting against the downward gravitational force applied to sidewall 116. This opposing force can aid golf cart cooler 100 in maintaining its shape, rigidity, and retention capabilities. Without strap 402, the gravitational force applied to sidewall 116 can cause sidewall 116 to flex or bend outward. This outward flexing can cause contents stored within storage area 130 to fall out. Strap 402 can provide a counter to the gravitational force, reducing or eliminating the bending or flexing of sidewall 116, and prevent or limit preventing contents from involuntarily spilling out.

In some embodiments, strap 402 may further act against the force or pressure applied by the contents within storage area 130 to sidewall 116. For example, when contents are stored in storage area 130, there may be instances when the contents may congregate to a specific area. When items congregate in such a manner, there is a tendency for the items to press up and push against sidewall 116, causing it to bend or flex outward from its original position. Strap 402 can act as a retention aid, providing a counterforce to sidewall 116. This counterforce provided by strap 402 reduces or eliminates outward flexing, bending, or otherwise loss of rigidity in sidewall 116. In some embodiments, while strap 402 can prevent or limit the outward flexing or bending of sidewall 116, sidewall 116 can still be bent or flexed inward toward the interior of main body 112, allowing golf cart cooler 100 to still be collapsible. This can be advantageous for storing or transporting golf cart cooler 100 when empty.

Fastening system 400 may provide for a more secure or durable attachment system over the prior art. In some embodiments, and as illustrated in FIG. 5, strap 402 can attach to golf cart 500 at two positions; at first portion 404 connected at a first position on golf cart 500 and second portion 450 connected at a second position on golf cart 500, with the middle portion of strap 402 attached to sidewall 116. When positioned in such a manner, the weight of the contents in storage area 130 and the force applied by gravity can be distributed across the entire length of strap 402 and along the perimeter of sidewall 116 where strap 402 is attached. By distributing weight and force along the length of strap 402, strap 402 alleviates overburdening the fasteners or connection points i.e., first fastening mechanism 406 and second fastening mechanism 452. This distribution of weight can aid in preventing strain or the build-up of tension at the fasteners and connection points where golf cart cooler 100 is attached to golf cart 500. The distribution of weight by strap 402 can therefore prevent or limit the frequency of golf cart cooler 100 from coming unattached to golf cart 500.

In acting as either a retention aid or as an attachment aid, it is advantageous for strap 402 to comprise a continuous design. For example, in acting as a retention aid, any gaps or breaks in strap 402 could allow for spots or locations of weakness that could be comprised. Such locations of weakness could cause sidewall 116 to bend or flex outward, allowing contents within golf cart cooler 100 to spill out. Similarly, in acting as an attachment aid, any gaps or breaks in strap 402 prevents the distribution of weight across the entire length of strap 402 and along the perimeter of sidewall 116. Without the distribution of weight across the entire length of strap 402, tension is more likely to build at the fastening points between golf cart cooler 100 and golf cart 500, and the chance of failure is increased. Therefore, it is advantageous for strap 402 to comprise a continuous design.

Figure 6:
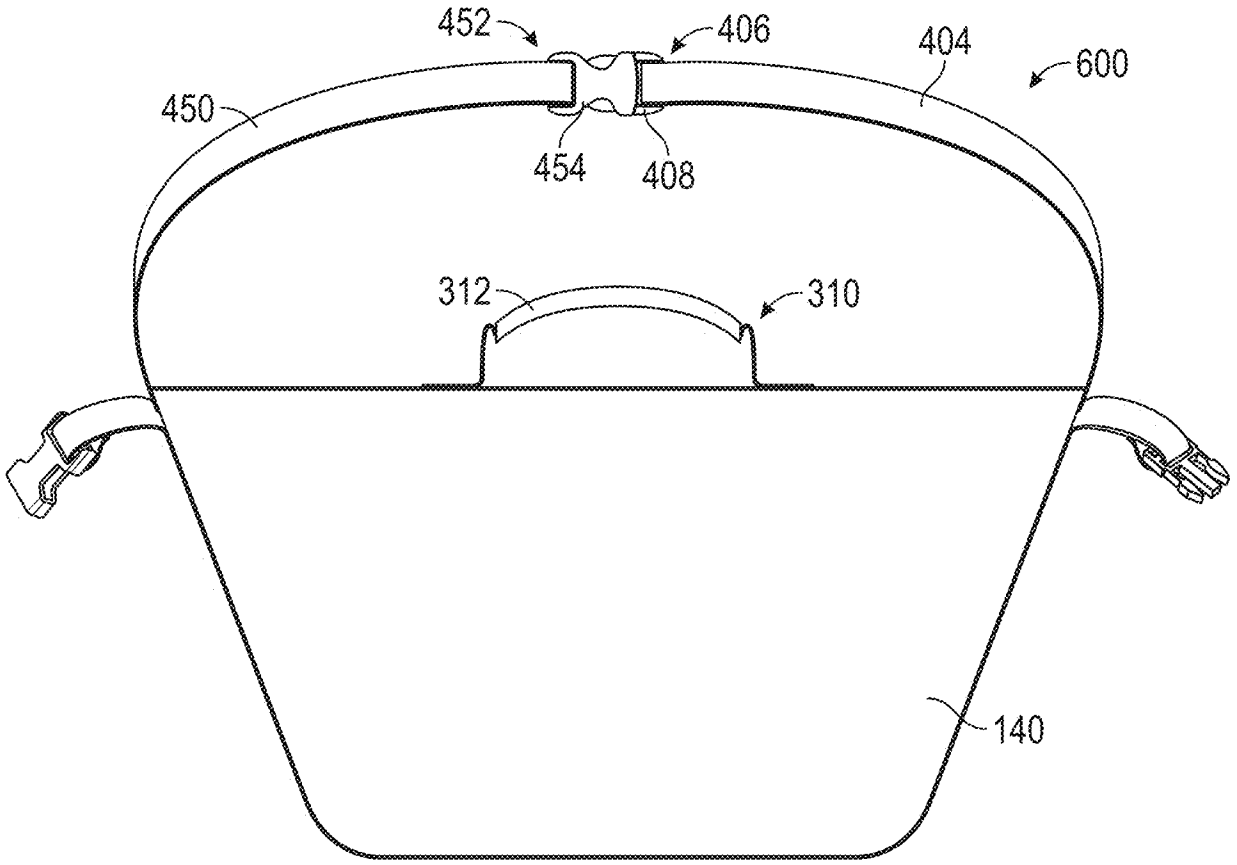
FIG. 6 is a top side perspective view of a golf cart cooler in a closed position and with the shoulder strap assembled in accordance with one embodiment of the present invention

Turning to FIG. 6, fastening system 400 may serve auxiliary functions, and for example, in some embodiments fastening system 400 may also be used to carry golf cart cooler 100 during transportation. In some embodiments, first portion 404 and second portion 450 may comprise complimentary fasteners, whereby first portion 404 and second portion 450 can be coupled together. For example, in some embodiments first portion 404 may comprise a male buckle 408 and second portion 450 may comprise a female buckle 454. First portion 404 and second portion 450 may then be coupled together to form shoulder strap 600. In alternate embodiments, first portion 404 and second portion 450 may be coupled together using any other known fasteners, including without limitation, hook and loop fasteners, magnets, clamps, or any other know fastening apparatus or method. Shoulder strap 600 may then be used as a carrying aid, providing for an improved method of transporting golf cart cooler 100 from one location to another. Fastening system 400 may further aid in preventing or limiting failures in shoulder strap 600. As described above, fastening system 400 can aid in distributing weight and force across the entire length of strap 402. This distribution of weight and force can prevent pockets of tension and strain acting on individual spots, such as at connection points. Accordingly, fastening system 400 can further aid in preventing system failure of shoulder strap 600, while golf cart cooler 100 is being carried via shoulder strap 600.

Although the invention has been described with reference to the embodiments illustrated in the attached drawing figures, it is noted that equivalents may be employed, and substitutions made herein without departing from the scope of the invention.

The invention claimed is:

1. A golf cart cooler configured to removably couple to a frame of a golf cart, the golf cart cooler comprising:

a main body comprising a base, a rear wall, a front wall, a first sidewall, and a second sidewall;

a continuous strap extending across at least a portion of the first sidewall, at least a portion of the front wall, and at least a portion of the second sidewall and secured to the first sidewall at a first securement point and to the second sidewall at a second securement point, the continuous strap comprising:

a first continuous strap portion that extends beyond the first securement point and includes a first fastener;

a second continuous strap portion that extends beyond the second securement point and includes a second fastener; and a middle continuous strap portion extending between the first continuous strap portion and the second continuous strap portion;

a first assistive strap portion that comprises a first assistive fastener configured to removably couple to the first fastener and that is secured to the first sidewall at the first securement point, wherein the first continuous strap portion and the first assistive strap portion are configured to form a first loop around a first vertically extending frame member of the frame of the golf cart to secure the golf cart cooler to the golf cart; and a second assistive strap portion that comprises a second assistive fastener configured to removably couple to the second fastener and is secured to the second sidewall at the second securement point, wherein the second continuous strap portion and the second assistive strap portion are configured to form a second loop around a second vertically extending frame member of the frame of the golf cart to secure the golf cart cooler to the golf cart.

2. The golf cart cooler of claim 1, wherein the continuous strap extends across at least 50% of a perimeter of the main body.

3. The golf cart cooler of claim 1, further comprising one or more handles located on the golf cart cooler.

4. The golf cart cooler of claim 1, wherein the first sidewall and the second sidewall have increasing heights towards the front wall.

5. The golf cart cooler of claim 1, wherein the main body further comprises:

a zipper system coupled to at least one of the rear wall, the front wall, the first sidewall, or the second sidewall and configured to selectively transition the golf cart cooler between an open position and a closed position; and a lid coupled to the zipper system such that the lid is uncoupled from at least one of the rear wall, the front wall, the first sidewall, or the second sidewall when the golf cart cooler is in the open position.

6. The golf cart cooler of claim 1, further comprising at least one additional storage compartment.

7. A golf cart cooler configured to removably couple to a frame of a golf cart, the golf cart cooler comprising:

a main body comprising a base and a sidewall extending from the base; and a plurality of straps, comprising:

a first strap for coupling the golf cart cooler to one or more frame members of the frame of the golf cart, wherein the first strap extends beyond a first securement point on the sidewall and includes a first fastener; and a second strap for coupling the golf cart cooler to the one or more frame members of the frame of the golf cart, wherein the second strap extends beyond a second securement point on the sidewall and includes a second fastener, wherein at least one of the first strap, the second strap, or at least one additional strap of the plurality of straps extends along at least a portion of an exterior surface of the sidewall, wherein the first fastener is operable to removably couple to the second fastener around a first vertically extending frame member and a second vertically extending frame member of the one or more frame members.

8. The golf cart cooler of claim 7, wherein the sidewall is non-uniform in height.

9. The golf cart cooler of claim 7, wherein the at least one of the first strap, the second strap, or the at least one additional strap extends across at least 20% of a perimeter of the sidewall.

10. The golf cart cooler of claim 7, wherein the at least one of the first strap, the second strap, or the at least one additional strap is positioned between a center point of the sidewall and an upper edge of the sidewall.

11. The golf cart cooler of claim 7, wherein the at least one of the first strap, the second strap, or the at least one additional strap is coupled at one or more additional positions on the sidewall.

12. The golf cart cooler of claim 7, wherein the main body comprises a thermally insulating material and the base further comprises a non-skid material.

13. The golf cart cooler of claim 7, wherein the main body further comprises a lid operatively attached to at least a portion of the sidewall and configured to selectively transition the golf cart cooler between an open position and a closed position.

14. A system for a removably attachable golf cart cooler configured to removably attach to a golf cart, the system comprising:

a golf cart cooler comprising:

a main body comprising a base, a rear wall, a front wall, a first sidewall, and a second sidewall; and a fastening system coupled to the golf cart cooler and configured to removably couple the golf cart cooler to a frame of the golf cart, the fastening system comprising:

a continuous strap comprising:

a first continuous strap portion that includes a first fastener;

a second continuous strap portion that includes a second fastener; and a middle continuous strap portion extending between the first continuous strap portion and the second continuous strap portion, wherein the middle continuous strap portion extends across the front wall, at least a portion of the first sidewall, and at least a portion the second sidewall;

a first assistive strap portion comprising a first assistive fastener configured to removably couple to the first fastener, wherein the first continuous strap portion and the first assistive strap portion are configured to form a first loop around a first vertically extending frame member of the frame of the golf cart to secure the golf cart cooler to the golf cart; and a second assistive strap portion comprising a second assistive fastener configured to removably couple to the second fastener, wherein the second continuous strap portion and the second assistive strap portion are configured to form a second loop around a second vertically extending frame member of the frame of the golf cart to secure the golf cart cooler to the golf cart.

15. The system of claim 14, wherein the first fastener includes a male fastener, and the second fastener includes a female fastener configured to removably couple to the male fastener to form a shoulder strap.

16. The system of claim 14, wherein the golf cart cooler further comprises one or more storage compartments.

17. The system of claim 14, wherein the golf cart cooler further comprises a thermally insulating material.

18. The system of claim 17, wherein the golf cart cooler further comprises a second material configured to provide rigidity to the main body, wherein the second material comprises at least one of plastic, wood, rubber, or synthetic polymer.

19. The system of claim 14, wherein the golf cart cooler further comprises at least one of a zipper, a hook and loop system, one or more snap fasteners, or one or more magnets for selectively transitioning the golf cart cooler between an open position and a closed position.

20. The system of claim 14, wherein the golf cart cooler further comprises one or more handles coupled to the main body.

* * * * *